US012649973B2

(12) United States Patent
Yang et al.

(10) Patent No.: US 12,649,973 B2
(45) Date of Patent: Jun. 9, 2026

(54) METHODS FOR CONTROLLING AND MONITORING THE DEGREE OF CATHODIC PROTECTION FOR METAL STRUCTURES AND BURIED PIPELINES USING COUPLED MULTIELECTRODE SENSORS

(71) Applicants: Xiaodong Sun Yang, Carson City, NV (US); Lietai Yang, Carson City, NV (US)

(72) Inventors: Xiaodong Sun Yang, Carson City, NV (US); Lietai Yang, Carson City, NV (US)

(73) Assignee: C2 Ventures LLC, Broadview Heights, OH (US)

( * ) Notice: Subject to any disclaimer, the term of this patent is extended or adjusted under 35 U.S.C. 154(b) by 0 days.

(21) Appl. No.: 18/650,873

(22) Filed: Apr. 30, 2024

(65) Prior Publication Data

US 2024/0279817 A1 Aug. 22, 2024

Related U.S. Application Data

(63) Continuation of application No. 18/225,886, filed on Jul. 25, 2023, now abandoned, which is a (Continued)

(51) Int. Cl.
*C23F 13/04* (2006.01)
*C23F 13/22* (2006.01)

(52) U.S. Cl.
CPC ..... *C23F 13/04* (2013.01); *C23F 13/22* (2013.01)

(58) Field of Classification Search
CPC ..... C23F 13/04; C23F 13/22; G01N 17/02
See application file for complete search history.

(56) References Cited

U.S. PATENT DOCUMENTS 4,644,285 A * 2/1987 Britton ..... C23F 13/04 204/196.03
4,795,539 A 1/1989 Bianchi et al.
(Continued)

FOREIGN PATENT DOCUMENTS

DE 2033172 A1 * 1/1972 ..... C23F 13/00
DE 102008032629 A1 * 1/2010 ..... C23F 13/04

OTHER PUBLICATIONS

Sun, Xiadong. "Online Monitoring Of Corrosion Under Cathodic Protection Conditions Utilizing Coupled Multielectrode Sensors." Paper presented at the CORROSION 2004, New Orleans, Louisiana, Mar. 2004, Paper No. 04094. (Year: 2004).*
(Continued)

*Primary Examiner* — Luan V Van
*Assistant Examiner* — Mofoluwaso S Jebutu

(57) ABSTRACT

A method and apparatus for using cathodic currents from individual electrodes of a multielectrode sensor to indicate how safely a pipe in soil, or a metal structure in an electrolyte, is cathodically protected. This method uses a simple parameter derived from the multielectrode sensor, called cathodic protection effectiveness margin, or CPEM, to indicate and control the cathodic protection (CP) system so that the CP operates within the optimal range. This method is solely based on the measurements of currents and eliminates the reference electrode that has been one of the most important components in the present CP practice.

20 Claims, 9 Drawing Sheets

Related U.S. Application Data continuation of application No. 16/873,922, filed on Aug. 11, 2020, now abandoned.

(56) References Cited

U.S. PATENT DOCUMENTS

| | | | | |
|---|---|---|---|---|
| 6,132,593 | A | 10/2000 | Tan | |
| 6,683,463 | B2 * | 1/2004 | Yang | G01N 17/02 324/696 |
| 6,987,396 | B2 | 1/2006 | Yang et al. | |
| 7,180,309 | B1 | 2/2007 | Yang | |
| 7,466,149 | B1 | 12/2008 | Yang | |
| 7,675,297 | B1 | 3/2010 | Yang et al. | |
| 2019/0085468 | A1 * | 3/2019 | Amaya | C23F 13/22 |

OTHER PUBLICATIONS

Xiaodong Sun, "Corrosion monitoring under cathodic protection conditions using multielectrode array sensors," in "Corrosion Monitoring Techniques," L. Yang, ed., Woodhead Publishing, Success, UK (2008), pp. 614 to 637.

Xiaodong Sun, Online Monitoring of Corrosion Under Cathodic Protection Conditions Utilizing Coupled Multielectrode Sensors, Corrosion 2004, Paper No. 04094 (Year: 2004).

Yuejiao Li, Weiguo Zeng, Xiufeng Li, Fajun Ren, Haijun Hu, Rank Predictions of Internal Corrosion of Gathering Pipelines in a Natural Gas Field With a Multi-Kernel SVM Method, Proceedings of the ASME 2020 Pressure Vessels & Piping Conference, Aug. 3, 2020 (Year: 2020).

Seang-Jong Kim, Masazumi Okido and Kyung-Man Moon, An Electrochemical Study of Cathodic Protection of Steel Used for Marine Structures, Korean J. Chem. Eng., 20(3), 560-565 (2003) (Year: 2003).

* cited by examiner

METHODS FOR CONTROLLING AND MONITORING THE DEGREE OF CATHODIC PROTECTION FOR METAL STRUCTURES AND BURIED PIPELINES USING COUPLED MULTIELECTRODE SENSORS

CROSS-REFERENCE TO RELATED APPLICATIONS

This application is a continuation of U.S. patent application Ser. No. 18/225,886, filed on Jul. 25, 2023, which is a continuation of U.S. patent application Ser. No. 16/873,922, filed on Aug. 11, 2020, now abandoned.

BACKGROUND OF THE INVENTION

Cathodic protection is widely used to prevent the corrosion of metal structures immersed in electrolytes and buried pipelines. Coupled multielectrode array sensors (CMAS) (see U.S. Pat. Nos. 6,683,463, 6,132,593, and 7180309) have been used for corrosion monitoring for cathodically protected systems [see X. Sun, "Corrosion monitoring under cathodic protection (CP) conditions using multielectrode array sensors," in "Corrosion Monitoring Techniques," L. Yang, ed., Woodhead Publishing, Success, UK (2008), Chapter 26, and pages 614 to 637]. However, the evaluation of the effectiveness of CP with the coupled multielectrode array sensors (CMAS) is by using the measured corrosion rate or corrosion current under the same CP conditions applied to the metal structures and pipelines. The corrosion rate decreases from a large value to zero and is an effective parameter for showing the effectiveness of CP when the CP changes from being ineffective to being just adequate to stop the corrosion. However, the corrosion rate remains zero and cannot be used to indicate the degree of CP when the CP changes from being just adequate to being excessive. Excessive CP should be avoided because it causes significant evolution of hydrogen which causes adverse effect such as the disbanding of the protective coatings on the metal or hydrogen embrittlement of the metal. To date, there is not a parameter from the CMAS probe that can be used to evaluate the effectiveness of CP when the when CP operates under the desired conditions. The CMAS probe cannot be used to control the CP systems to operate within the optimum range of conditions.

SUMMARY

This invention is related to a method on how to control and monitor the CP for immersed metal structures and buried pipeline so that it operates in the desired range between being adequate and being excessive by using parameters from a multielectrode electrochemical sensor. This method does not need a reference electrode which requires periodical service and has a limited service life.

Advantages

Cathodic protection (CP) control has been relying on the measurements of structure-to-electrolyte potentials. The commonly accepted criterion for controlling CP is that the instant-off structure-to-electrolyte potential is within a certain range so that the CP is adequate but not excessive. For example, the instant-off potential should be between −0.85 and −1.2 V vs $Cu/CuSO_4$ ($V_{CSE}$) for pipelines buried in soil. However, the measurement of such potentials requires a reference electrode which usually contains a liquid electrolyte and requires periodical maintenance and has a limited service life, especially under wet and dry conditions. In addition, the effective range of potentials varies somewhat with temperature and pH of the surrounding soil. Corrosion may occur even within the specified range. This invention enables the evaluate the effectiveness of CP without the need to measure the potential and eliminate errors associated with the reference electrodes and the uncertainties of using the potential to evaluate the effectiveness of the CP.

DETAILED DESCRIPTIONS OF THE INVENTION

Reference Numbers of Drawings

Figure 1:
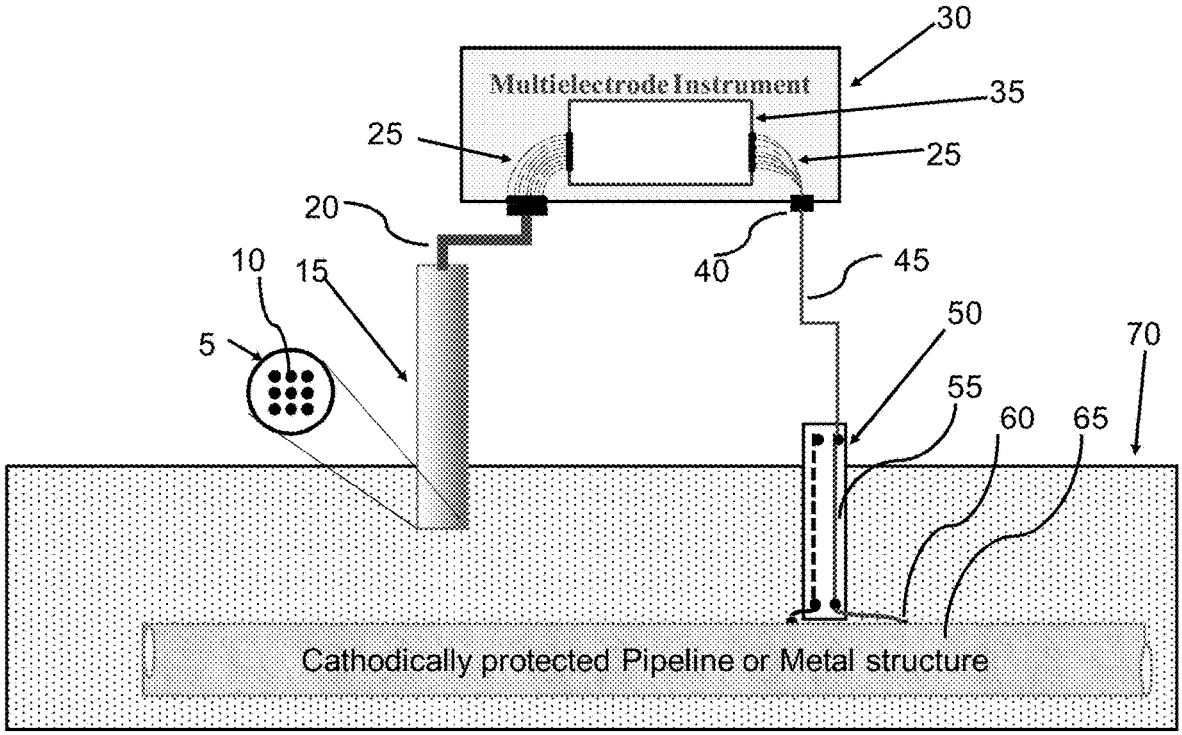
FIG. 1 (Prior Art)
FIG. 1 (prior art) illustrates the use of a multielectrode sensor for monitoring corrosion of a buried pipe or other metal structure under cathodic protection.

5—sensing surface of multielectrode probe (15) viewed from the lower end of the probe

10—individual electrodes on the sensing surface exposed to the corrosive electrolyte (soil for example)

10*a*—electrodes that are made from a type of metal

10*b*—electrodes that are made from another type of metal

10*c*—electrodes that are made from a metal that is further different from 10*a* and 10*b*

15—multielectrode probe (or coupled multielectrode array sensor probe)

20—electrical cable of probe

25—electrical wires connecting each individual electrode to a current-measuring device (35)

30—multielectrode instrument

31—multielectrode instrument for CP Control

35—multi-channel ammeter in the multielectrode instrument

40—coupling joint where all wires from individual electrodes are joined

45—wire connecting the coupling joint (40) to the buried pipe or immersed metal (65) under cathodic protection

50—test station for buried pipe or metal structures where the access to the electrical cables (55) that are connected to the buried pipe or immersed metal structure (65) are available

55—electrical cable connected to the buried pipe or immersed metal structures (65)

60—point where the electrical cable (55) is electrically jointed to the buried pipe or metal structure (65)

65—buried pipe or immersed metal structure in contact with the corrosive electrolyte or soil (70).

70—electrolyte that causes corrosion (soil for example)

75—rectifier that provides the CP for the buried pipe or immersed metal in the case of the impressed current cathodic protection systems

Figure 2:
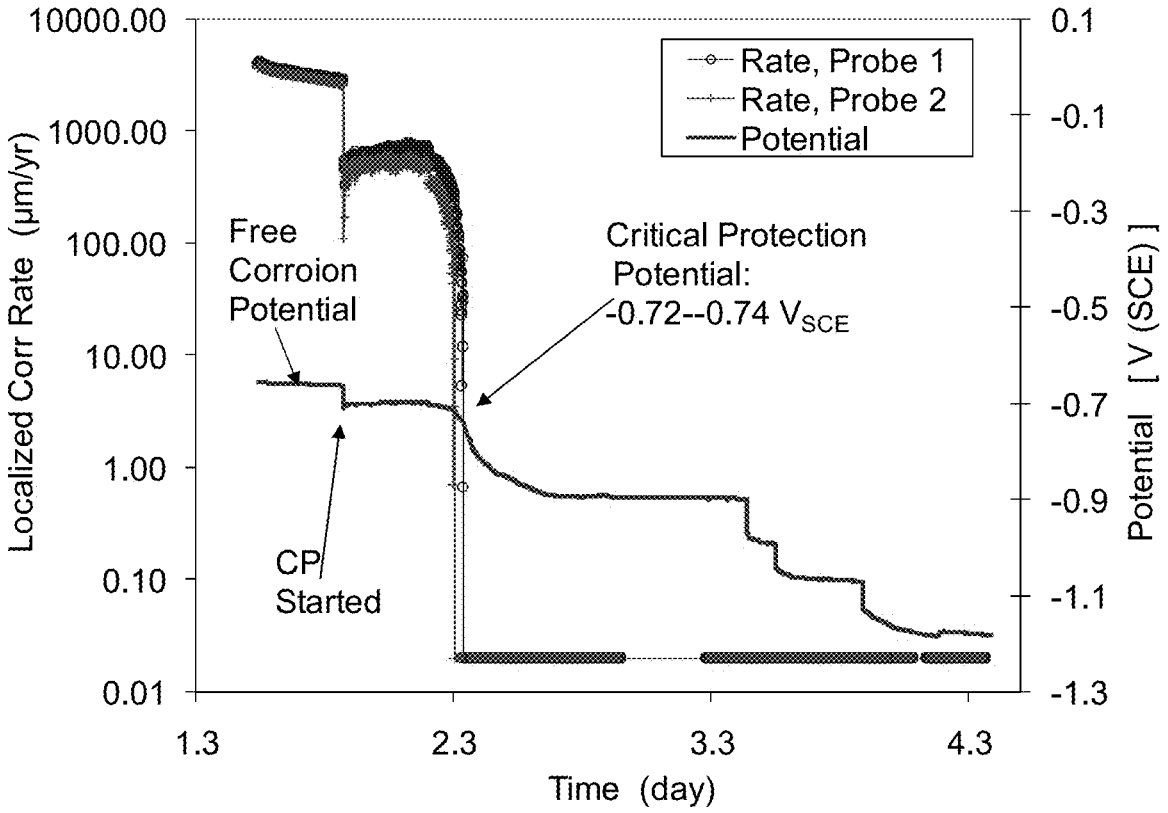
FIG. 2 (Prior Art)
FIG. 2 (prior art) illustrates the corrosion rates from two multielectrode sensors at different potentials and how the corrosion rates were used for monitoring the effectiveness of CP.

80—anode that is buried in the soil or immersed in the electrolyte surrounding the metal FIGS. 1 and 2 (Prior Art)

FIG. 1 shows how a coupled multielectrode array sensor (CMAS) probe is used to measure the corrosion rate of a buried pipe that is under cathodic protection. The electrodes of the probe (10) are made of the same metal that has the same or similar metallurgical properties as the buried pipe. Because the coupling joint of the probe (40) is electrically connected to the pipe (65), all the electrodes (10) are at the same electrode potential of the buried pipe (65) and their corrosion behaviors simulate that of the buried pipe surfaces that are in direct contact with electrolyte (70). The corrosion currents are measured by the multi-channel ammeter (35) and converted to corrosion rate by the multielectrode instrument according to Faraday's Law.

FIG. 2 shows typical corrosion rate calculated for the worst corroding electrodes on the CMAS sensor. The multielectrode sensor effectively measured the corrosion rate when the cathodic protection was insufficient. As the CP potential became more negative and reached the critical protection potential, the corrosion rate was zero, indicating that the metal was adequately protected.

In practice, CP is usually applied such that the metal structure is slightly over protected (with the CP potential slightly lower than the critical protection potential) to guarantee that there is a safe margin of the protection, but not excessive protection which may cause significant evolution of hydrogen and damage to the coatings on the metals as well as hydrogen embrittlement. Since the minimum corrosion rate is zero (corrosion rate cannot be negative) and, to date, there has not been a way to represent the safe margin of the CP for the CMAS probe.

This invention discloses a method on how to use the currents measured from a multielectrode sensor for monitoring the effectiveness to cathodic protection and control the cathodic protection within the optimum range.

FIGS. 3A, 3B

Figure 3A:
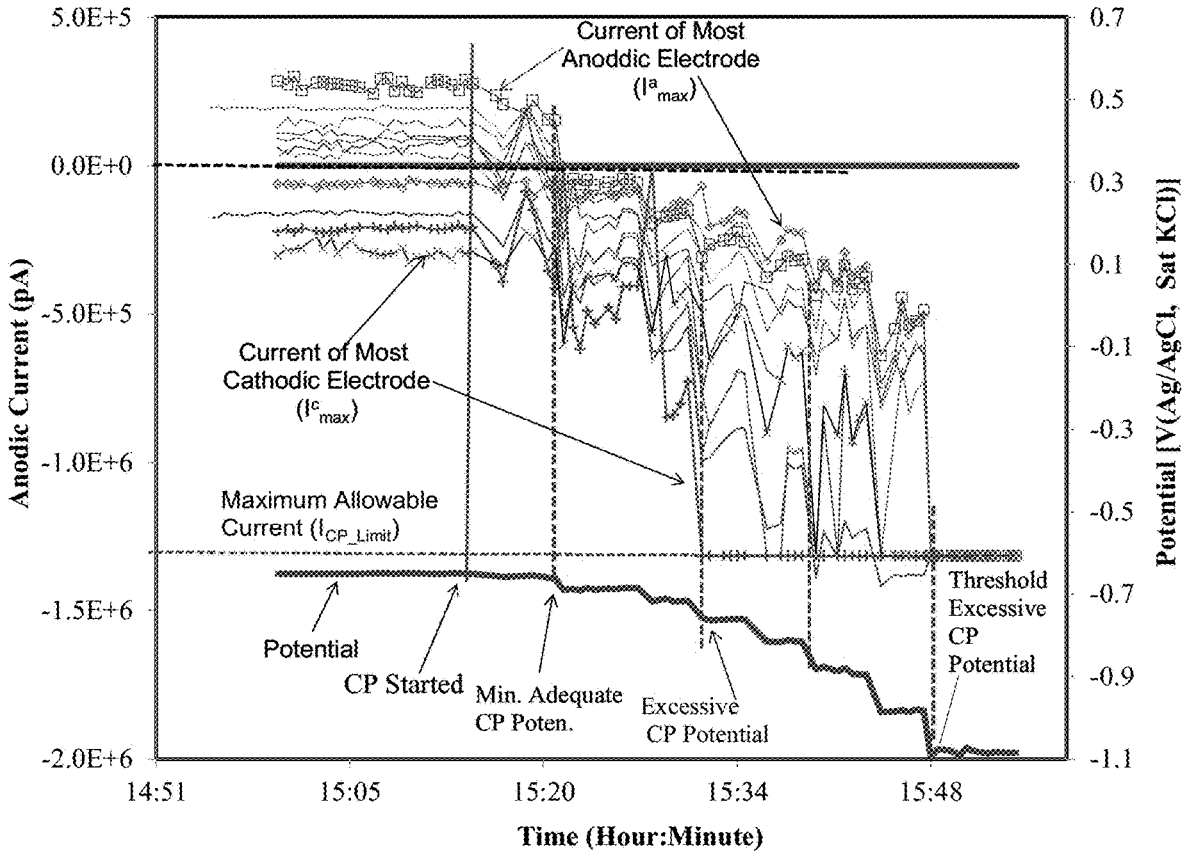
FIG. 3A illustrates the response of currents from the individual electrodes of a multielectrode sensor to the application of CP.

FIG. 3A shows the typical currents from the individual electrodes (made from a same metal wire) of a multielectrode sensor before and after the application of CP. In FIG. 3A, the positive currents are anodic currents and the negative current are cathodic currents. The $I^c_{max}$ and $I^a_{max}$ are the current from the most cathodic electrodes and the current from the most anodic electrode, respectively. Note, $I^c_{max}$ is not always from the same electrode if one electrode is the most cathodic at one time, but other electrodes become the most cathodic electrode at another time. This is also true for the $I^a_{max}$.

Before the application of the CP, the potential of the coupling joint was at the free corrosion potential. At the corrosion potential, some electrodes were anodes and some electrodes were cathodes and the current from the most anodic electrode ($I^a_{max}$) represented the maximum corrosion current on the multielectrode sensor. After the CP was applied, all of the currents started to decrease and the $I^a_{max}$ reached zero when the CP potential reached the minimum adequate CP potential. When the $I^a_{max}$ reached zero, the metal was fully protected because the most anodic electrode (which represents the most vulnerable corrosion site of the metal) is protected.

As the CP potential further decreased, both $I^c_{max}$ and the $I^a_{max}$ became more and more negative. When the CP potential reached another critical value (the excessive CP potential), $I^c_{max}$ jumped to a large negative value which usually indicates that significant hydrogen evolution started on the most cathodic electrode. This large negative value is called the maximum allowable CP current ($I_{CP_limit}$) because it corresponds to the excessive hydrogen evolution (see the section for FIG. 6 below). As the CP potential further decreased and reached the threshold excessive CP potential, $I^a_{max}$ also jumped to the maximum allowable CP current which indicates that significant hydrogen evolution also started on the most anodic electrode. Because hydrogen evolution is an undesired reaction and should be avoided. The CP potential should be controlled between the minimum adequate CP potential and the excessive CP potential for optimum CP control, or at least between the minimum adequate CP potential and the threshold excessive CP potential. Consequently, finding the maximum allowable CP current that corresponds to the excessive hydrogen evolution and then controlling the $I^a_{max}$ between zero and this maximum allowable current is an effective way to control the CP. Alternatively, controlling the $I^a_{max}$ below zero and the $I^c_{max}$ above the maximum allowable CP current is even a better way to control the CP, if possible.

The current from the most anodic electrode and the current from the most cathodic electrode may also be represented by the values derived using statistic methods for more reliable results. Such values are called the statistical most anodic current ($I^a_{max,stat}$) and the statistical most cathodic current ($I^c_{max,stat}$). For example, the statistical most anodic current may be derived by using the sum of the average of all the currents from the multiple electrodes (AVG) and the standard deviation (STD) of all the currents times a factor (k):

$$I^a_{max,stat}=\mathrm{AVG}+k\times STD$$

where k is a positive number from 0.5 to 5.

Similarly, the statistical most cathodic current may be derived by using the difference between the average of all the currents from the multiple electrodes (AVG) and the standard deviation (STD) of all the currents times the factor:

$$I^c_{max,stat} = AVG - kxSTD$$

Figure 3B:
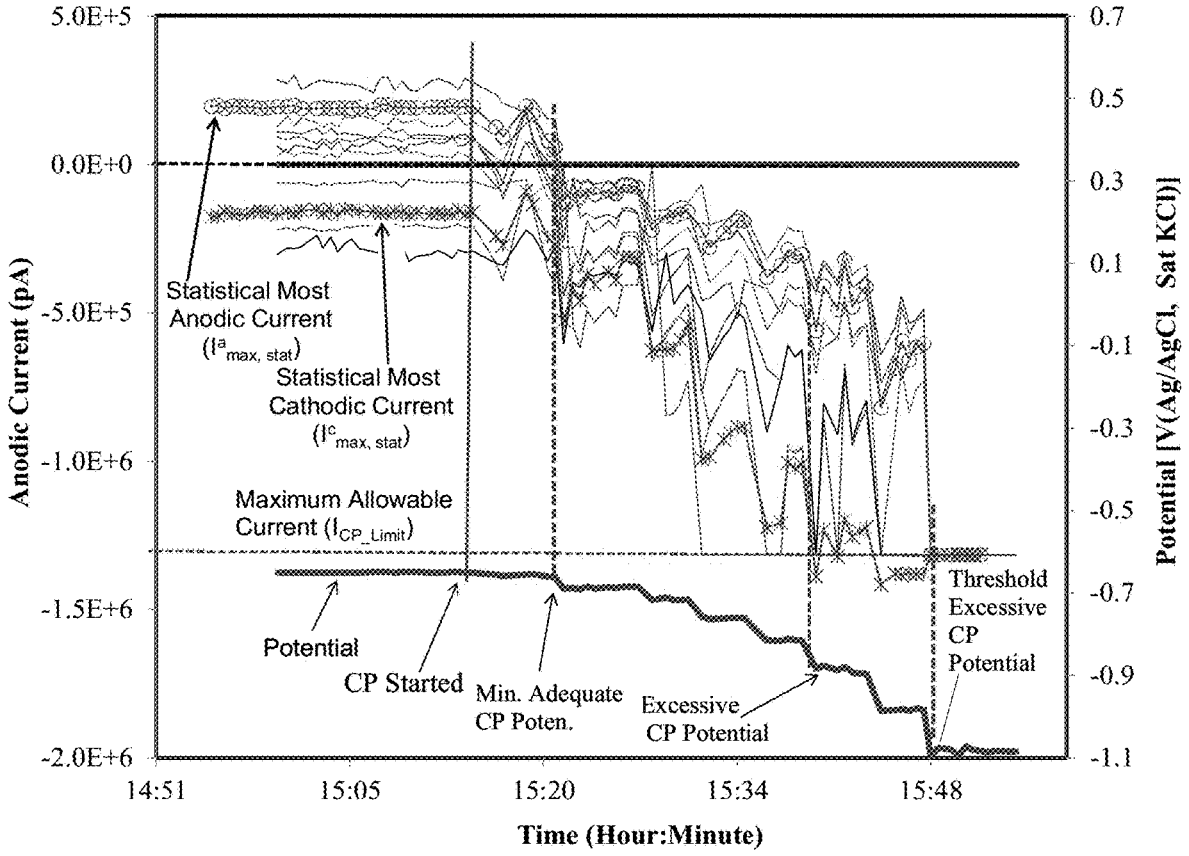
FIG. 3B illustrates the statistically obtained most anodic current and the statistically obtained most cathodic current and the currents from the individual electrodes of a multielectrode sensor to the application of CP.

FIG. 3B shows the statistical most anodic current ($I^a_{max,stat}$), the statistical most cathodic current ($I^c_{max,stat}$), and all the currents from the individual electrodes of a multielectrode sensor before and after the application of CP. In FIG. 3B, the k value used in the calculation was 1 (it can also be other values though). Accordingly, the minimum adequate CP potential and the threshold excessive CP potential are determined by the statistical most anodic current ($I^a_{max,stat}$) and the excessive CP potential is determined by the statistical most cathodic current (($I^c_{max,stat}$). As shown in FIG. 3B, the potential at which the $I^a_{max,stat}$ is zero reaches the minimum adequate CP potential, the potential at which $I^c_{max,stat}$ reaches the maximum allowable CP current is the excessive CP potential, and the potential at which $I^a_{max,stat}$ reaches the maximum allowable CP current is the threshold excessive CP potential.

When the $I^a_{max,stat}$ reached zero, the metal was fully protected because the statistical most anodic current statistically represents the corrosion current from the most vulnerable corrosion site of the metal. When the $I^c_{max,stat}$ reached the maximum allowable value, statistically, there is excessive hydrogen evolution at one of the sites on the metal. The CP potential controlled between the minimum adequate CP potential and the excessive CP potential as shown in FIG. 3B may be more effective than the CP potential controlled between the minimum adequate CP potential and the excessive CP potential as shown in FIG. 3. This is because the values in FIG. 3A are determined from only two of the multiple electrodes and the values in FIG. 3B are determined from all of the electrodes using the statistical approach.

Responses of the CP effectiveness margin (CPEM) to the CP potential. Note: the CPEM was calculated with the current from the statistical most anodic electrode. The CPEM was calculated with the current from the statistical most cathodic electrode and its value of 100% corresponds to the Excessive CPEM.

Figure 4:
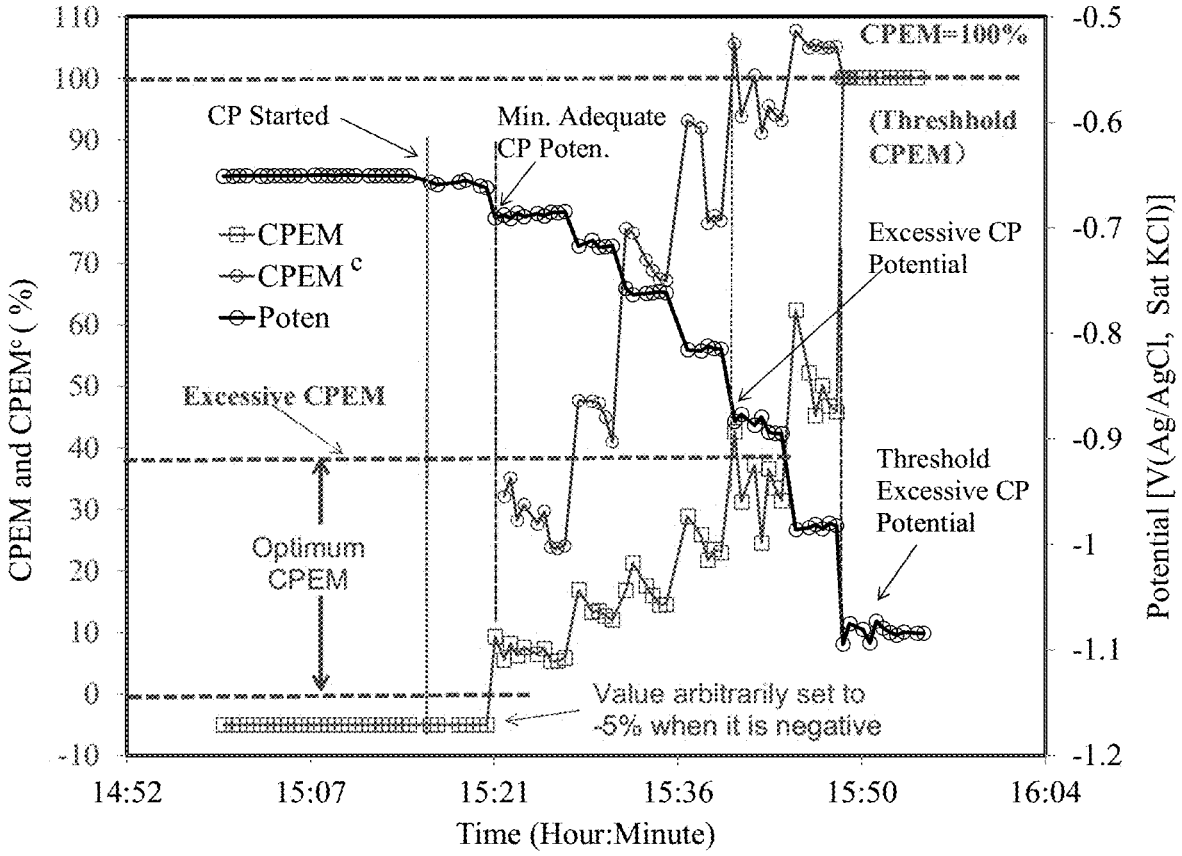
FIG. 4 illustrates that the ratio between the cathodic current from the most anodic electrode and the maximum allowable CP current that corresponds to the excessive hydrogen evolution can be used to represent the CP effectiveness margin (CPEM).
Figure 5:
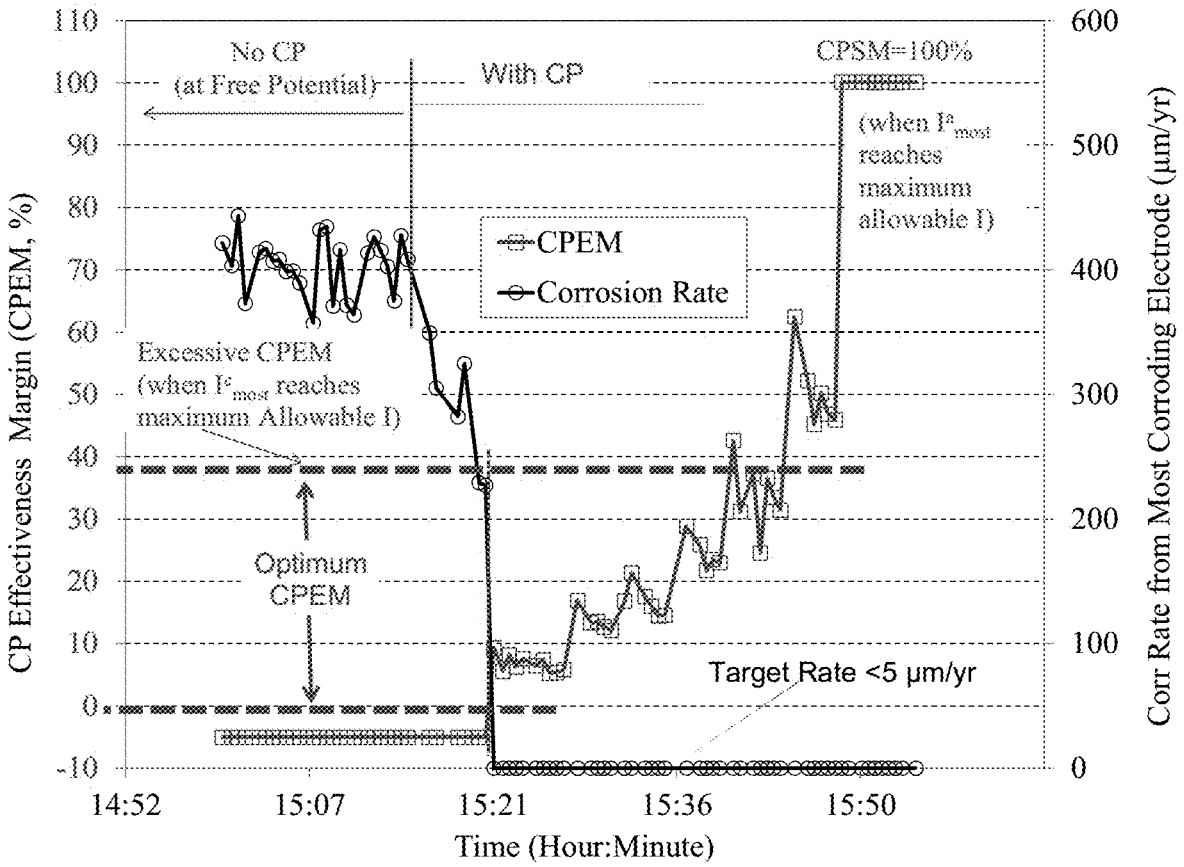
FIG. 5. illustrates how the CP effectiveness margin and the corrosion rate from a multielectrode sensor can be used together to effectively control and monitor the cathodic protect.
Figure 6:
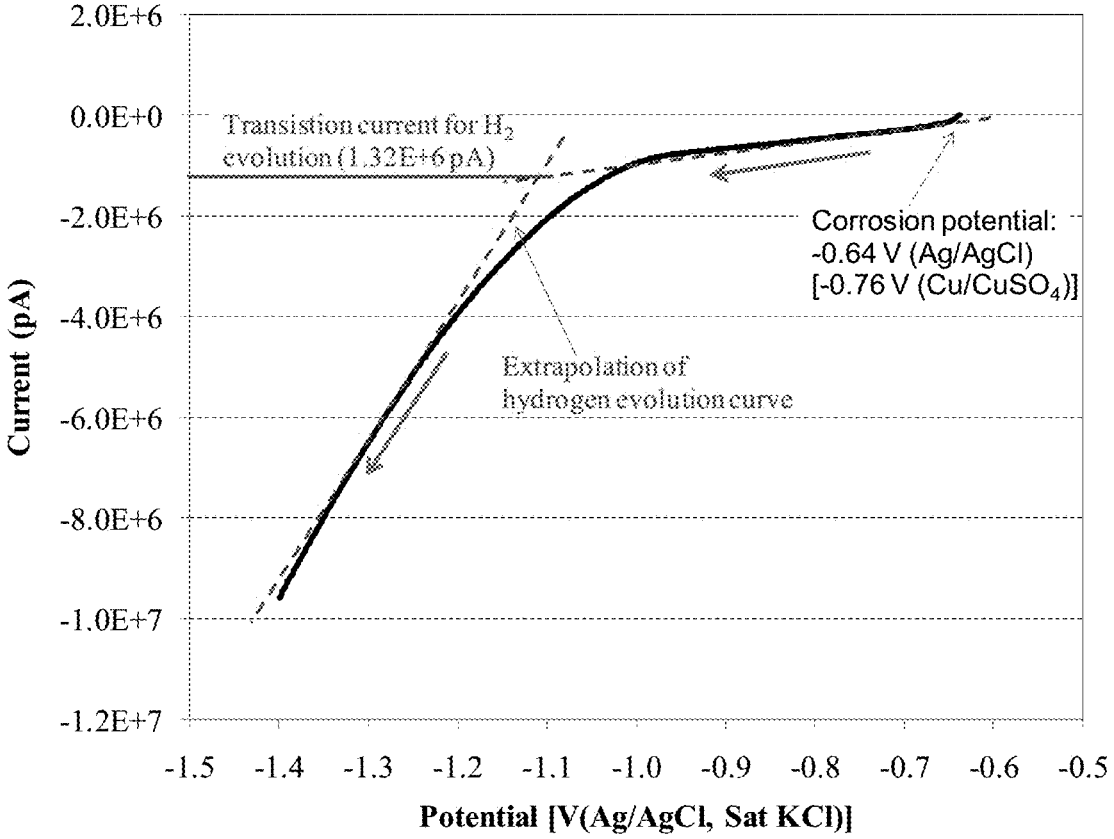
FIG. 6 shows how the maximum allowable CP current that is used to derive the CP effectiveness margin is obtained.

FIGS. 4, 5, and 6

FIG. 4 shows that the ratio of the $I^a_{max,stat}$ (the statistical most anodic current as shown in FIG. 3B) to the $I_{CP_limit}$ (maximum allowable CP current that corresponds to the excessive hydrogen evolution which was set to $-1.32\times10^6$ pA (see section for FIG. 6 below) can be used to represent the degree of cathodic protection called the cathodic protection effectiveness margin (CPEM) in this invention. When the CPEM is negative, $I^a_{max,stat}$ is larger than zero and statistically there is still at least one electrode under corrosion which means that the CP is insufficient. When the CPEM is equal to or more than zero, $I^a_{max,stat}$ is equal to or lower than zero and, statistically, all electrodes are fully protected[1]. The corresponding potential is the minimum adequate CP potential. The CPEM that corresponds to the threshold excessive CP potential is called the threshold CPEM. When the CPEM is reached the threshold CPEM, $I^a_{max,stat}$ reached $I_{CP_limit}$ and, statistically, the most difficult to protect site on the metal is undergoing excessive hydrogen evolution. So, the CPEM should be controlled between 0 and 100%.

[1]Some standards consider that when corrosion rate is less than a satisfactory value (such as 10 μm/yr), the metal is satisfactorily protected. Here we use the term of "fully protected" which is a higher bar for CP.

The $CPEM^c$ in FIG. 4 is the ratio of the $I^c_{max,stat}$ (the statistical most cathodic current as shown in FIG. 3B) to the $I_{CP_limit}$. When the $CPEM^c$ is 100%, $I^c_{max,stat}$ is equal to $I_{CP_limit}$, meaning that statistically significant hydrogen evolution reaction occurs on at least one of the electrodes (the most cathodic electrode). The CPEM corresponding to $CPEM^c$ being 100% is called the excessive CPEM. Therefore, the optimum range of CPEM value should be between 0 and the excessive CPEM.

FIG. 5 shows how the CPEM and the corrosion rate from the same CMAS probe can be used together to effectively monitor the effectiveness of CP. When the CP is insufficient, the CPEM is negative, and the degree of corrosion is shown by the corrosion rate; when the CP starts to be sufficient, the corrosion rate reaches zero and loses its effectiveness as the indicator for the degree of protection, but the CPEM starts to increase. The CPEM can be used to guide the operator on how to control the CP to the optimum condition after the CP is more than sufficient.

FIG. 6, Maximum Allowable Current

FIG. 6 shows how the maximum allowable current or current density is obtained. If it is in an aerated system, the cathodic current is mainly due to the reduction of oxygen when the electrode of the multielectrode sensor is moderately polarized in the negative direction and the current value gradually decreases with the decrease of potential. As the polarization progresses to the more negative direction, the cathodic current starts to be dominated by the reduction reaction of hydrogen ions and decreases more rapidly with the decrease of potential. The inflection point of the curve may be considered as the starting point for the excessive evolution of hydrogen and can be used as the maximum allowable current as shown in FIGS. 3A and 3B. In FIG. 6, the current shown was the average of all the electrodes on the multielectrode sensor. The inflection point was $-1.32\times10^6$ pA and this is why the maximum allowable current was set to $-1.32\times10^6$ pA in FIG. 3A and FIG. 3B. The electrodes used for FIGS. 3-6 were made of Type 1018 carbon steel wire (1 mm diameter) and the exposed surface area for each electrode was the cross section (0.78 $mm^2$). The electrolyte used was 0.5 M NaCl solution which simulates the seawater.

Alternatively, a much easier method may be used to obtain the approximate value of the maximum allowable current. This easier method requires only the measurement of the current from the multielectrode probe or a coupon made of the same metal as the electrode of the probe while polarizing the probe or the coupon to the maximum allowable CP potential specified in a relevant standard (e.g. −1.2 $V_{CSE}$). The current density derived from the current measured at the threshold excessive CP potential can be used as the maximum allowable current density or the maximum allowable current after the electrode surface area is accounted for.

After more data in the different soil or electrolyte environments are available, the maximum allowable current can be estimated.

The maximum allowable CP current can also be arbitrarily set to the negative of the current from the most anodic electrode times a factor between 1 and 10 before cathodic protection is applied. The maximum allowable CP current can also be arbitrarily set to the current from the most cathodic electrode times a factor between 1 and 10 before cathodic protection is applied.

Figure 7:
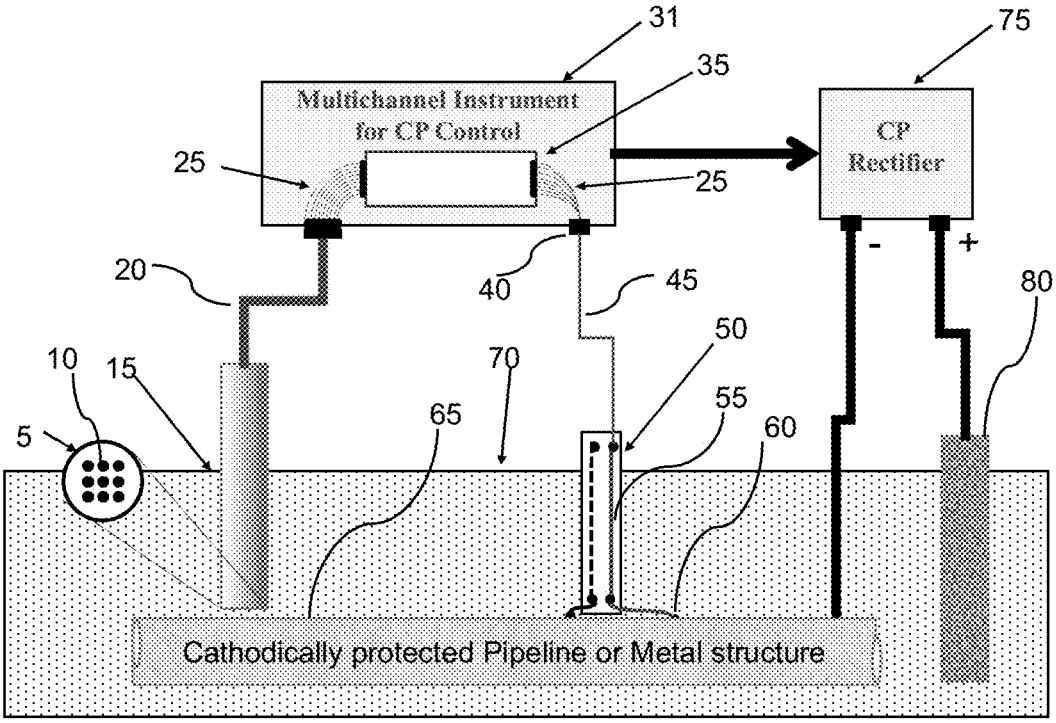
FIG. 7 shows the embodiment for how to use the multielectrode probe to monitor and control the CP for impressed current cathodic protection systems

FIG. 7 Physical Devices

FIG. 7 shows the setup for how to use the multielectrode probe (15) to monitor and control the CP for impressed current cathodic protection systems. The multielectrode instrument for CP control (31) has the capability to derive the above mentioned parameters ($I^a_{max}$ or $I^a_{max,stat}$, $I^c_{max}$ or $I^c_{max,stat}$, and $I_{CP_limit}$ and send command to the rectifier (75) for it to increase or decrease the current flow between the buried pipe or immersed metal and the anode (80) for the CP to operate at the optimum condition. For example, when the $I^a_{max,stat}$ is larger than zero (higher than a predetermined acceptable value according to the applicable standards), the rectifier should provide more current; when the $I^c_{max,stat}$ is lower than the $I_{CP_limit}$, the rectifier should provide less current. If it is not practical to control the $I^c_{max,stat}$ above the $I_{CP_limit}$, the rectifier should at least control the $I^a_{max,stat}$ above $I_{CP_limit}$ by decreasing the output CP current.

Alternatively, the multielectrode instrument for CP control (31) has the capability to derive the above-mentioned CPEM and control the rectifier's outputs such that the CPEM is between 0 and the excessive CPEM. If it is not practical to control the CPEM to be between 0 and the excessive CPEM, The CPEM should at least be control between 0 and 100%.

Figure 8:
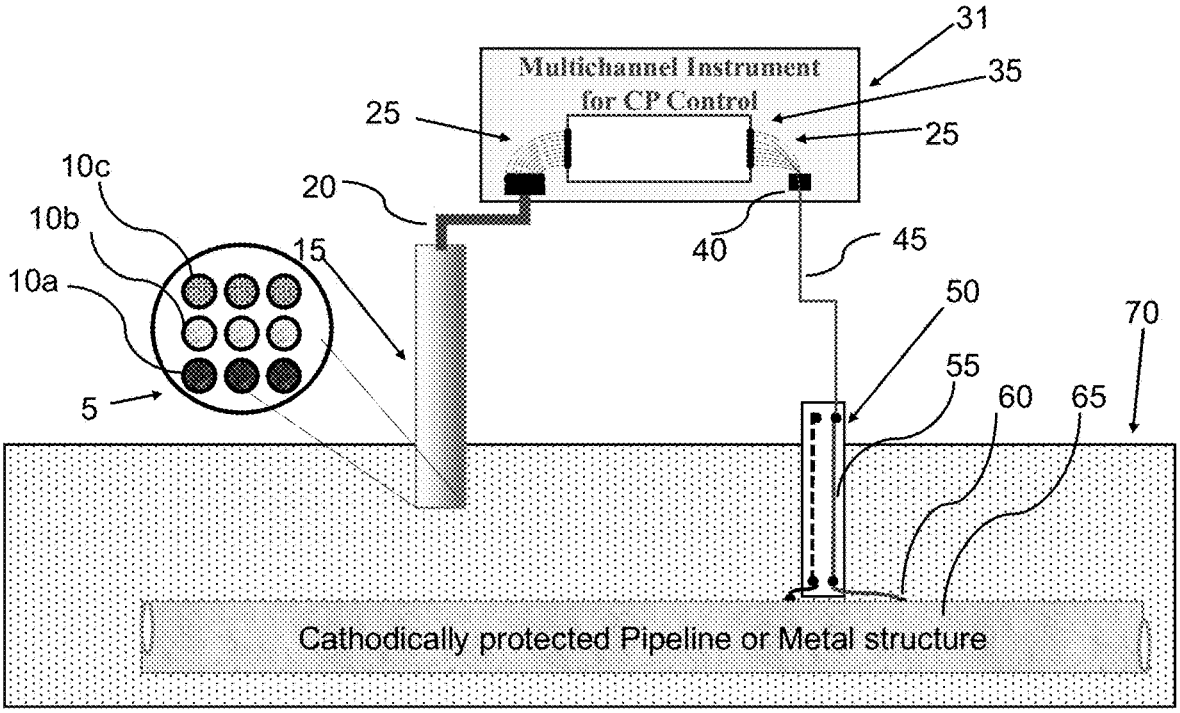
FIG. 8 illustrates a multielectrode sensor with the electrodes made from different type of metals.

FIG. 8 Alternative Embodiments

In a coupled multielectrode array sensor (CMAS), the electrodes are usually made of the same metal that represents the pipe wall or the metal structure whose corrosion rate is being measured. In this case, the variations of the measured currents from the CMAS (some small and some large and some are anodic and some are cathodic) reflect the variations of the microstructure of the pipe wall or metal structure being measured and also the variations of the local chemistry in contact with the metal surface.

FIG. 8 shows that the electrodes of the multielectrode sensor in this invention can be made of slightly different metals. For example 10*a* is made of a carbon steel that is the same as the metal being measured, 10*b* is made of a carbon steel that has more impurities such as sulfur and is less corrosion resistant than the metal being measured, and 10*c* is made of a carbon steel that has more chromium and is more corrosion resistant than the metal being measured. In this way, the results from this type of multielectrode sensor can give a more reliable optimum range for cathodic protection.

In addition, for legacy pipelines, especially those that have been repaired, or that have sections being replaced, the pipeline that is under the same CP protection system is actually consisted of different metals. The multielectrode sensor as shown in FIG. 8 can have the electrodes that represent the different type of metals used in the difference sections of the same pipeline.

Variations and Other Embodiments

In the above discussion, the denominator used to derive the degree of cathodic protection or CPEM is the maximum allowable CP current which is predetermined based on the extrapolation of the hydrogen evolution curve or measurement of current when the electrode is polarized to the threshold CP potential. This value may be replaced by a more easily obtainable value such as the $I^a_{max}$, or $I^c_{max}$, before or after CP as shown in FIG. 3A, or by the difference of ($I^a_{max}$–$I^c_{max}$) which represents the span of variation in the measured currents. The denominator may also be replaced simply by the average, standard deviation, or standard deviation times a constant.

The method described are mainly for monitoring the degree of cathodic protection of pipes buried in soil and metal structures immersed in electrolyte solutions. The method may also be used in other systems and environments.

Although the present invention has been described in detail, it should be understood that various changes, substitutions, and alterations can be made hereto, without departing from the spirit and scope of the invention as defined by the appended claims.

CONCLUSIONS, RAMIFICATIONS, AND SCOPE

Accordingly, the method disclosed in this invention uses a new parameter derived from the current from the most anodic electrode and the current from the most cathodic electrode of a multielectrode sensor, or the ratio of such currents to a large cathodic value, called the maximum allowable for CP control. This ratio is called the cathodic protection effectiveness margin (CPEM). It allows the operator to safely control the CP without using a reference electrode. When the CP is insufficient, the CPEM is less than zero; when the CP is sufficient, the CPEM is between 0 and 100%. The value of 0% means that the system is just barely protected, while the value of 100% means that the CP starts to be excessive. Therefore, the CPEM is an effective parameter for monitoring and controlling the CP.

Compared with the commonly adopted instant-off potential criteria, the method disclosed in this invention does not require a reference electrode. As the multielectrode probe is consisted of only metal electrodes and solid insulators, it is maintenance free and its service life may be the same as the protected structures. In addition, the multielectrode probe also provide the quantitative information on the degree of corrosion damage when the CP is insufficient.

The invention claimed is:

1. A cathodic protection system for protecting a metal structure (65) within an electrolyte (70), comprising:

a multielectrode non-liquid-containing probe (15) having an insulator and a plurality of individual metal electrodes (10) including at least a first electrode, a second electrode, and a third electrode, with a first electrode current associated with the first electrode, a second electrode current associated with the second electrode, and a third electrode current associated with the third electrode, wherein the multielectrode non-liquid-containing probe (15) is at least partially located within the electrolyte (70);

a multielectrode CP instrument (31) having a multi-channel ammeter (35) in electrical communication with the plurality of individual metal electrodes (10) of the multielectrode non-liquid-containing probe (15) via a probe cable (20);

an anode (80) at least partially located within the electrolyte (70); and a CP rectifier (75) in electrical communication with the multielectrode CP instrument (31), the metal structure (65), and the anode (80), wherein the CP rectifier (75) generates and controls a CP current flow through the metal structure (65) and the plurality of individual metal electrodes (10) of the multielectrode non-liquid-containing probe (15);

wherein:

the multi-channel ammeter (35) receives and monitors the first electrode current, the second electrode current, and the third electrode current, and the multielectrode CP instrument (31) identifies an initial most anodic electrode from the first electrode, the second electrode, and the third electrode, and an associated initial most anodic current ($I^a_{max}$) from the first electrode current, the second electrode current, and the third electrode current;

the multielectrode CP instrument (31) controls the CP rectifier (75) to generate and control the CP current to achieve a zero value of the initial most anodic current ($I^a_{max}$) from the initial most anodic electrode, and then:

the multielectrode CP instrument (31) monitors the first electrode current, the second electrode current, and the third electrode current, and the multielectrode CP instrument (31) identifies a controlled current ($I^a_{max}$) associated with an initially positive-current electrode selected from the first electrode, the second electrode, and the third electrode current, that is now a controlled negative-current electrode selected from the first electrode, the second electrode, and the third electrode based upon which of the first electrode current, the second electrode current, and the third electrode current is negative but closest to zero, and determines a cathodic protection effectiveness margin (CPEM), defined as a percentage ratio of the controlled current ($I^a_{max}$) to a maximum allowable CP current ($I_{CP\ limit}$); and the multielectrode CP instrument (31) controls the CP rectifier (75) to adjust and maintain the CP current to (a) maintain the controlled current ($I^a_{max}$) at no greater than zero, and (b) maintain the cathodic protection effectiveness margin (CPEM) between zero and 100%.

2. The cathodic protection system of claim 1, wherein the multielectrode CP instrument (31) monitors the controlled current ($I^a_{max}$) and controls the CP rectifier (75) to adjust and maintain the CP current to maintain the cathodic protection effectiveness margin (CPEM) greater than zero %.

3. The cathodic protection system of claim 2, wherein after the start of monitoring the controlled current ($I^a_{max}$), the multielectrode CP instrument (31) monitors the first electrode current, the second electrode current, and the third electrode current, and the multielectrode CP instrument (31) identifies a post-CP most cathodic current ($I^c_{max}$) associated with a post-CP most cathodic electrode, and controls the CP rectifier (75) to adjust and maintain the CP current to maintain the cathodic protection effectiveness margin (CPEM) to less than an excessive CPEM corresponding to a point where the post-CP most cathodic current ($I^c_{max}$) equals a maximum allowable CP current ($I_{CP\ limit}$) associated with hydrogen evolution on at least one of the plurality of individual electrodes (10).

4. The cathodic protection system of claim 3, wherein the multielectrode CP instrument (31) monitors the post-CP most cathodic current ($I^c_{max}$) and determines a second cathodic protection effectiveness margin ($CPEM^c$), defined as a percentage ratio of the post-CP most cathodic current ($I^c_{max}$) to the maximum allowable CP current ($I_{CP\ limit}$), and the multielectrode CP instrument (31) controls the CP rectifier (75) to adjust and maintain the CP current to keep the second cathodic protection effectiveness margin ($CPEM^c$) between zero and 100%.

5. The cathodic protection system of claim 4, wherein the multielectrode CP instrument (31) monitors the controlled current ($I^a_{max}$) and, when the controlled current ($I^a_{max}$) is equal to the maximum allowable CP current ($I_{CP\ limit}$), the multielectrode CP instrument (31) controls the CP rectifier (75) to adjust and maintain the CP current so the second cathodic protection effectiveness margin ($CPEM^c$) is less than 100%, and the initial most anodic electrode is the first electrode while the controlled negative-current electrode is the second electrode.

6. The cathodic protection system of claim 4, wherein the multielectrode CP instrument (31) monitors the post-CP most cathodic current ($I^c_{max}$) and controls the CP rectifier (75) to adjust and maintain the CP current flow so that the post-CP most cathodic current ($I^c_{max}$) is greater than the maximum allowable CP current ($I_{CP\ limit}$), and an initial most cathodic electrode is the first electrode while the post-CP most cathodic electrode is the second electrode.

7. The cathodic protection system of claim 4, wherein the multielectrode CP instrument (31) monitors the controlled current ($I^a_{max}$) and controls the CP rectifier (75) to adjust and maintain the CP current flow so that the controlled current ($I^a_{max}$) is greater than the maximum allowable CP current ($I_{CP\ limit}$), and the post-CP most cathodic electrode is the second electrode at a first time and the post-CP most cathodic electrode is the third electrode at a second time.

8. The cathodic protection system of claim 4, wherein the first electrode comprises a first electrode material, and the second electrode comprises a second electrode material different than the first electrode material.

9. The cathodic protection system of claim 8, wherein at least one of the first electrode material and the second material is the same as a material of the metal structure (65).

10. A cathodic protection system for protecting a metal structure (65) within an electrolyte (70), comprising:

a multielectrode non-liquid-containing probe (15) having an insulator and a plurality of individual metal electrodes (10) including at least a first electrode, a second electrode, and a third electrode, with a first electrode current associated with the first electrode, a second electrode current associated with the second electrode and different than the first electrode current, and a third electrode current associated with the third electrode and different than the second electrode current, wherein the multielectrode non-liquid-containing probe (15) is at least partially located within the electrolyte (70), and the first electrode comprises a first electrode material, the second electrode comprises a second electrode material different than the first electrode material, and the third electrode comprises a third electrode material different than the first electrode material;

a multielectrode CP instrument (31) having a multi-channel ammeter (35) in electrical communication with the plurality of individual metal electrodes (10) of the multielectrode non-liquid-containing probe (15) via a probe cable (20);

an anode (80) at least partially located within the electrolyte (70); and a CP rectifier (75) in electrical communication with the multielectrode CP instrument (31), the metal structure (65), and the anode (80), wherein the CP rectifier (75) generates and controls a CP current flow through the metal structure (65) and the plurality of individual metal electrodes (10) of the multielectrode non-liquid-containing probe (15);

wherein:

the multi-channel ammeter (35) receives and monitors the first electrode current, the second electrode current, and the third electrode current, and the multielectrode CP instrument (31) identifies an initial most anodic electrode from the first electrode, the second electrode, and the third electrode, and an associated initial most anodic current ($I^a_{max}$) from the first electrode current, the second electrode current, and the third electrode current;

the multielectrode CP instrument (31) controls the CP rectifier (75) to generate and control the CP current to achieve a zero value of the initial most anodic current ($I^a_{max}$) from the initial most anodic electrode, and then:

the multielectrode CP instrument (31) monitors the first electrode current, the second electrode current, and the third electrode current, and the multielectrode CP instrument (31) identifies a controlled current ($I^a_{max}$) associated with an initially positive-current electrode selected from the first electrode, the second electrode, and the third electrode current, that is now a controlled negative-current electrode selected from the first electrode, the second electrode, and the third electrode based upon which of the first electrode current, the second electrode current, and the third electrode current is negative but closest to zero, and determines a cathodic protection effectiveness margin (CPEM), defined as a percentage ratio of the controlled current ($I^a_{max}$) to a maximum allowable CP current ($I_{CP\ limit}$); and the multielectrode CP instrument (31) controls the CP rectifier (75) to adjust and maintain the CP current to (a) maintain the controlled current ($I^a_{max}$) at no greater than zero, and (b) maintain the cathodic protection effectiveness margin (CPEM) between zero and 100%.

11. The cathodic protection system of claim 10, wherein after the start of monitoring the controlled current ($I^a_{max}$), the multielectrode CP instrument (31) monitors the first electrode current, the second electrode current, and the third electrode current, and the multielectrode CP instrument (31) identifies a post-CP most cathodic current (I max) associated with a post-CP most cathodic electrode, and controls the CP rectifier (75) to adjust and maintain the CP current to maintain the cathodic protection effectiveness margin (CPEM) to less than an excessive CPEM corresponding to a point where the post-CP most cathodic current ($I^c_{max}$) equals a maximum allowable CP current ($I_{CP\ limit}$) associated with hydrogen evolution on at least one of the plurality of individual electrodes (10).

12. The cathodic protection system of claim 11, wherein the multielectrode CP instrument (31) monitors the post-CP most cathodic current ($I^c_{max}$) and determines a second cathodic protection effectiveness margin ($CPEM^c$), defined as a percentage ratio of the post-CP most cathodic current ($I^c_{max}$) to the maximum allowable CP current ($I_{CP\ limit}$), and the multielectrode CP instrument (31) controls the CP rectifier (75) to adjust and maintain the CP current to keep the second cathodic protection effectiveness margin ($CPEM^c$) between zero and 100%.

13. The cathodic protection system of claim 12, wherein the multielectrode CP instrument (31) monitors the controlled current ($I^a_{max}$) and, when the controlled current ($I^a_{max}$) is equal to the maximum allowable CP current ($I_{CP\ limit}$), the multielectrode CP instrument (31) controls the CP rectifier (75) to adjust and maintain the CP current so that the second cathodic protection effectiveness margin ($CPEM^c$) is less than 100%.

14. The cathodic protection system of claim 12, wherein the multielectrode CP instrument (31) monitors the post-CP most cathodic current ($I^c_{max}$) and controls the CP rectifier (75) to adjust and maintain the CP current flow so that the post-CP most cathodic current (I max) is greater than the maximum allowable CP current ($I_{CP\ limit}$).

15. The cathodic protection system of claim 12, wherein the multielectrode CP instrument (31) monitors the controlled current ($I^a_{max}$) and controls the CP rectifier (75) to adjust and maintain the CP current flow so that the controlled current ($I^a_{max}$) is greater than the maximum allowable CP current ($I_{CP\ limit}$).

16. The cathodic protection system of claim 15, wherein at least one of the first electrode material, the second electrode material, and the third electrode material is less corrosion-resistant than the metal structure (65), and at least one of the first electrode material, the second electrode material, and the third electrode material is more corrosion-resistant than the metal structure (65).

17. A cathodic protection system for protecting a metal structure (65) within an electrolyte (70), comprising:

a multielectrode non-liquid-containing probe (15) having an insulator and a plurality of individual metal electrodes (10) including at least a first electrode, a second electrode, and a third electrode, with a first electrode current associated with the first electrode, a second electrode current associated with the second electrode, and a third electrode current associated with the third electrode, wherein the multielectrode non-liquid-containing probe (15) is at least partially located within the electrolyte (70), and the first electrode comprises a first electrode material, and the second electrode comprises a second electrode material different than the first electrode material, and at least one of the first electrode material and the second material is the same as a material of the metal structure (65);

a multielectrode CP instrument (31) having a multi-channel ammeter (35) in electrical communication with the plurality of individual metal electrodes (10) of the multielectrode non-liquid-containing probe (15) via a probe cable (20);

an anode (80) at least partially located within the electrolyte (70); and a CP rectifier (75) in electrical communication with the multielectrode CP instrument (31), the metal structure (65), and the anode (80), wherein the CP rectifier (75) generates and controls a CP current flow through the metal structure (65) and the plurality of individual metal electrodes (10) of the multielectrode non-liquid-containing probe (15);

wherein:

the multi-channel ammeter (35) (15) receives and monitors the first electrode current, the second electrode current, and the third electrode current, and the multi-electrode CP instrument (31) identifies an initial most anodic electrode from the first electrode, the second electrode, and the third electrode, and an associated initial most anodic current ($I^a_{max}$) from the first electrode current, the second electrode current, and the third electrode current;

the multielectrode CP instrument (31) controls the CP rectifier (75) to generate and control the CP current to achieve a zero value of the initial most anodic current ($1^a$max from the initial most anodic electrode, and then:

the multielectrode CP instrument (31) monitors the first electrode current, the second electrode current, and the third electrode current, and the multielectrode CP instrument (31) identifies a controlled current ($I^a_{max}$) associated with an initially positive-current electrode selected from the first electrode, the second electrode, and the third electrode current, that is now a controlled negative-current electrode selected from the first electrode, the second electrode, and the third electrode based upon which of the first electrode current, the second electrode current, and the third electrode current is negative but closest to zero, and determines a cathodic protection effectiveness margin (CPEM), defined as a percentage ratio of the controlled current ($I^a_{max}$) to a maximum allowable CP current ($I_{CP\ limit}$);

the multielectrode CP instrument (31) controls the CP rectifier (75) to adjust and maintain the CP current to (a) maintain the controlled current ($I^a_{max}$) at no greater than zero, and (b) maintain the cathodic protection effectiveness margin (CPEM) at zero % or greater;

after the start of monitoring the controlled current ($1^a$max), the multielectrode CP instrument (31) monitors the first electrode current, the second electrode current, and the third electrode current, and the multielectrode CP instrument (31) identifies a post-CP most cathodic current ($I^c_{max}$) associated with a post-CP most cathodic electrode, and controls the CP rectifier (75) to adjust and maintain the CP current to maintain the cathodic protection effectiveness margin (CPEM) to less than an excessive CPEM; and the multielectrode CP instrument (31) monitors the post-CP most cathodic current ($I^c$ max) and determines a second cathodic protection effectiveness margin ($CPEM^c$), defined as a percentage ratio of the post-CP most cathodic current (I max) to a maximum allowable CP current ($I_{CP\ limit}$), and the multielectrode CP instrument (31) controls the CP rectifier (75) to adjust and maintain the CP current to keep the second cathodic protection effectiveness margin ($CPEM^c$) between zero and 100%.

18. The cathodic protection system of claim 17, wherein the multielectrode CP instrument (31) monitors the controlled current ($I^a_{max}$) and, when the controlled current ($I^a_{max}$) is equal to the maximum allowable CP current ($I_{CP\ limit}$), excessive CP the multielectrode CP instrument (31) controls the CP rectifier (75) to adjust and maintain the CP current so that the second cathodic protection effectiveness margin ($CPEM^c$) is less than 100%.

19. The cathodic protection system of claim 17, wherein the multielectrode CP instrument (31) monitors the post-CP most cathodic current (I max) and controls the CP rectifier (75) to adjust and maintain the CP current flow so that the post-CP most cathodic current ($I^c_{max}$) is greater than the maximum allowable CP current ($I_{CP\ limit}$).

20. The cathodic protection system of claim 17, wherein the multielectrode CP instrument (31) monitors the controlled current ($I^a_{max}$) and controls the CP rectifier (75) to adjust and maintain the CP current flow so that the controlled current ($I^a_{max}$) is greater than the maximum allowable CP current ($I_{CP\ limit}$).

* * * * *